US005635791A

United States Patent [19]

Vickers

[11] Patent Number: 5,635,791

[45] Date of Patent: Jun. 3, 1997

[54] FIELD EMISSION DEVICE WITH CIRCULAR MICROTIP ARRAY

[75] Inventor: Kenneth G. Vickers, Whitesboro, Tex.

[73] Assignee: Texas Instruments Incorporated, Dallas, Tex.

[21] Appl. No.: 518,829

[22] Filed: Aug. 24, 1995

[51] Int. Cl.[6] ..... H01J 1/16

[52] U.S. Cl. ..... 313/309; 313/310; 313/336; 313/351

[58] Field of Search ..... 313/309, 310, 313/336, 351, 495

[56] References Cited

U.S. PATENT DOCUMENTS

| | | | |
|---|---|---|---|
| 3,453,478 | 7/1969 | Shoulders | 313/336 |
| 3,745,402 | 7/1973 | Shelton et al. | 313/309 |
| 3,755,704 | 8/1973 | Spindt et al. | 313/309 |
| 3,795,838 | 3/1974 | Hill | 313/309 |
| 3,812,559 | 5/1974 | Spindt et al. | 29/25.18 |
| 3,814,968 | 6/1974 | Nathanson et al. | 313/309 |
| 3,852,595 | 12/1974 | Aberth | 313/309 |
| 4,818,914 | 4/1989 | Brodie | 313/336 |
| 4,857,161 | 8/1989 | Borel et al. | 204/192.26 |
| 4,940,916 | 7/1990 | Borel et al. | 313/306 |
| 5,194,780 | 3/1993 | Meyer | 315/35 |
| 5,225,820 | 7/1993 | Clerc | 340/752 |
| 5,514,847 | 5/1996 | Makishima et al. | 313/309 |

FOREIGN PATENT DOCUMENTS 2687839 8/1993 France .

*Primary Examiner*—Sandra L. O'Shea
*Assistant Examiner*—Vip Patel
*Attorney, Agent, or Firm*—Warren L. Franz; Wade James Brady, III; Richard L. Donaldson

[57] ABSTRACT

An electron emitter plate (110) for an FED image display has an extraction (gate) electrode (122) spaced by an insulating layer (25) from a cathode electrode including a conductive mesh (118). Circular arrays (112) of microtips (14) are located concentrically within circular mesh spacings (116) on a resistive layer (15), within apertures (26) formed in extraction electrode (122). Microtips (14) are laterally spaced from mesh structure (118) by substantially identical paths of a ballast-providing resistive layer (15), placing all microtips (14) at generally the same potential.

19 Claims, 5 Drawing Sheets

FIELD EMISSION DEVICE WITH CIRCULAR MICROTIP ARRAY

TECHNICAL FIELD OF THE INVENTION

The present invention relates generally to electron emitting structures of the field emission type; and, in particular, to improved microtip emission cathode structures and FED field emission flat-panel image display devices utilizing such structures.

BACKGROUND OF THE INVENTION

Examples of conventional electron emitting devices of the type to which the present invention relates are disclosed in U.S. Pat. Nos. 3,755,704; 3,812,559; 4,857,161; 4,940,916; 5,194,780 and 5,225,820. The disclosures of those patents are incorporated herein by reference.

Microtip emission cathode structures usable in FED field emission flat-panel image display devices, as described in the referenced patents, typically comprise thin film metal/insulator/metal sandwich structures deposited on a glass or silicon support substrate. In a usual self-aligning method of fabrication, first and second conductive layers are deposited on the substrate, separated by an intervening dielectric insulating layer which functions to space and insulate the conductive layers. The bottom conductive layer functions as the emitting or cathode electrode. The top conductive layer functions as the extractor or gate electrode. Apertures are formed in the top conducting layer and in the intervening dielectric material, and a microtip emitter (sometimes called an electron field emitting spike, needle or protuberance) is formed within each aperture in electrical communication with the bottom conductive layer. Traditional designs have placed the emitters in either random or rectangular matrix arrays.

Early implementations formed the microtips directly on the lower or cathode electrode. Such arrangements, however, provided little protection against excessive current draw. The use of a resistive layer was therefore proposed to provide a ballast against excessive current in each microtip emitter, and consequently to homogenize the electron emission. The Borel, et al. '916 patent describes the use of a resistive layer above the cathode electrode and beneath the microtips. Such vertical resistor approach helps eliminate nonuniformity caused by excessively bright spots and reduces breakdown risk at the microtips by limiting current flow when local short-circuiting occurs between individual microtips and the gate. Under the Borel approach, however, when a short circuit occurs between a microtip and the gate, the full voltage applied between the gate and cathode conductors is applied vertically across the resistive coating. This requires the resistive coating to be thick enough to withstand the full gate-to-cathode voltage without breaking down due to heat. Thus, the existence of "pinhole" or other defects which locally reduce thickness of the resistive layer will lead to breakdown.

The Meyer '780 patent overcomes this deficiency by use of a lateral resistor cathode structure for a field emission device. A plurality of arrays of electrically conductive microtips are formed on a resistive layer, within respective mesh spacings of a conductive layer which is patterned into a mesh structure configuration. This arrangement provides an improvement in breakdown resistance of a field effective emissive device, without requiring increasing the thickness of the resistive layer. The mesh-like structure of the cathode conductor (and/or the gate conductor), permits the cathode conductor and the resistive coating to lie substantially in the same plane. In such configuration, the breakdown resistance is no longer susceptible to defects in the vertical thickness of the resistive coating, because it is the lateral separation of the microtips from the cathode conductor by the resistive coating which provides the ballast against excessive current. It is therefore, sufficient to maintain a horizontal distance between the cathode conductor and the microtip which is adequate to prevent breakdown, while still retaining a homogenization affect for which the resistive coating is supplied.

In both the '916 and '780 approaches, the ballast is in the form of a resistive voltage drop, such that those microtips drawing the most current have the greatest resistive drop, thus acting in such a way as to limit microtip current. An equivalent circuit of the '916 or '780 ballast arrangement would have each tip in series with an individual buffer resistor to limit the field emission current. However, the ballast resistance between the microtips and the cathode conductor varies with the position of the individual microtip within the array. In a four-by-four rectangular matrix array, for example, a microtip in the corner of the array has a lower ballast resistance than a microtip at the side of the array, and a microtip in the side has a lower ballast resistance than a microtip in the interior.

The difference in ballast resistance among microtips becomes even more pronounced as the size of the array or the spacing between microtips increases. There is, therefore, a need for microtip emission cathode structures, and displays incorporating such structures, having all microtips in the same array at substantially equal potential.

An FED (field emission device) flat-panel image display device of the type described in Meyer U.S. Pat. No. 5,194,780 is shown in FIGS. 1–4. Such device includes an electron emitter plate 10 spaced across a vacuum gap from an anode plate 11 (FIG. 1). Emitter plate 10 comprises a cathode electrode having a plurality of cellular rectangular arrays 12 of electrically conductive microtips 14 formed on a resistive layer 15, within respective rectangular mesh spacings 16 (FIG. 2) of rectangular grid mesh structure 18, patterned in stripes 19 (referred to as "columns") (FIG. 4) on an upper surface of an electrically insulating (typically glass) substrate 20 overlaid with a thin silicon dioxide ($SiO_9$) film 21. An extraction (or gate) electrode 22 (FIGS. 1 and 2) comprises an electrically conductive layer of cross-stripes 24 (referred to as "rows") (FIG. 4) deposited on an insulating dielectric layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in U.S. Pat. No. 3,755,704, wherein apertures 26 and cavities 41 are etched after deposition of layers 22, 25 and wherein a respective microtip 14 is formed within each aperture 26 and cavity 41. The relative parameters of microtips 14, insulating layer 25 and conductive layer 22 are chosen to place the apex of each microtip 14 generally at the level of layer 22 (FIG. 1). Electrode 22 is patterned to form rectangular aperture islands or pads 27 centrally of the mesh spacings 16 in the vicinity of microtip arrays 12, and to remove cross-shaped areas 28 (FIG. 2) over the intersecting conductive strips which form the mesh structure of conductor 18. Bridging strips 29 of electrode 22 are left for electrically interconnecting pads 27 of the same row cross-stripe 24.

Anode plate 11 (FIG. 1) comprises an electrically conductive layer of material 31 deposited on a transparent insulating (typically glass) substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a coating of phosphor cathodoluminescent material 34, deposited over the conductive layer 31, so as to be directly facing and immediately adjacent extraction electrode 22. In accordance with conventional teachings, groupings of the microtip cellular arrays 12 in mesh spacings 16 corresponding to a particular column-row image pixel location can be energized by applying a negative potential to a selected column stripe 19 (FIG. 4) of cathode mesh structure 18 relative to a selected row cross-stripe 24 of extraction electrode 22, via a voltage source 35, thereby inducing an electric field which draws electrons from the associated subpixel rectangular arrays of microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 28, completing the electrical circuit to voltage source 35.

As can be seen in FIG. 3, the ballast resistance between microtips 14 and cathode mesh structure 18 varies with the position of the individual microtip 14 within the array 12. In the illustrated four-by-four array 12, for example, there are three "classes" of emitters 14, with different resistive paths R1, R2, R3 to the conductive grid 18 through the resistive layer 15. Microtips **14*c* in the corners of array 12 will have a lower ballast resistance than microtips 14*s* located at the external sides of array 12. Microtips 14*i* located in the interior will have the highest ballast resistance. The effect of the difference in ballast resistance among microtips 14 becomes even more pronounced as the size of the array increases to the point where, in a five-by-five or a six-by-six array, the potential at one or more of the innermost microtips may insufficiently support electron emission. Thus, an arrangement is desired which will enable all microtips 14** to be at a substantially equal potential.

SUMMARY OF THE INVENTION

The invention provides an electron emitting structure of the field emission type having lateral ballast resistance and arrays of microtips, wherein individual microtips are at substantially the same potential. In particular, the invention provides a thin-film microtip emission cathode structure having a layer of conductive material patterned in a mesh structure defining mesh spacings, and conductive microtips arranged in circular arrays concentrically located centrally within said mesh spacing. The microtips of each array are arranged on circles, with microtips of the same circle laterally and equally spaced from the mesh structure by a resistive layer. Such concentric arrangement provides substantially equal resistive paths between the individual microtips and the mesh structure.

Preferred embodiments of the invention, discussed in greater detail below, provide a mesh structure with a hexagonal close-packed set of circular mesh spacings, and at least one circular array of microtips concentrically located within each mesh spacing. The microtips are preferably equiangularly distributed about the array circle. To maintain substantial uniformity of microtip resistive paths, yet increase tip packing density, a secondary circle of microtips is provided, concentric with a primary circle, with the tips of the secondary circle placed in equilateral triangular relationships with the tips of the primary circle. One embodiment has the secondary circle inside the primary circle. Another embodiment has the secondary circle outside the primary circle. Such close-packed arrangements provide a high packing density of microtips with substantially equal ballasted resistive paths and, thus, at generally uniform voltage potential.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1—1 of FIG. 2;

FIG. 2 is a top plan view of a portion of a pixel of the image forming area of the cathode plate of the display;

FIG. 3 is an enlarged top plan view, with gate electrode layer removed, of one subpixel mesh spacing of the display; and FIG. 4 is a schematic macroscopic top view of a corner of the cathode plate useful in understanding the row-column, pixel-establishing intersecting relationships between the cathode grid and pad-patterned gate electrodes shown in greater enlargement in FIG. 2.

FIG. 5 is a view, similar to that of FIG. 1 and corresponding to a section taken along the line 5—5 of FIG. 6, of a display incorporating an electron emitting structure in accordance with the invention;

FIG. 6 is a view, similar to that of FIG. 1, of the display of FIG. 5;

FIGS. 7A–7C are views, similar to that of FIG. 3, of microtip emitter arrays usable in the display of FIGS. 5 and 6; and FIGS. 8A–8C are views helpful in understanding the arrangements of microtips in the arrays of FIGS. 8A–8C, respectively.

Throughout the drawings, like elements are referred to by like numerals.

DETAILED DESCRIPTION OF PREFERRED EMBODIMENTS

Figure 1:
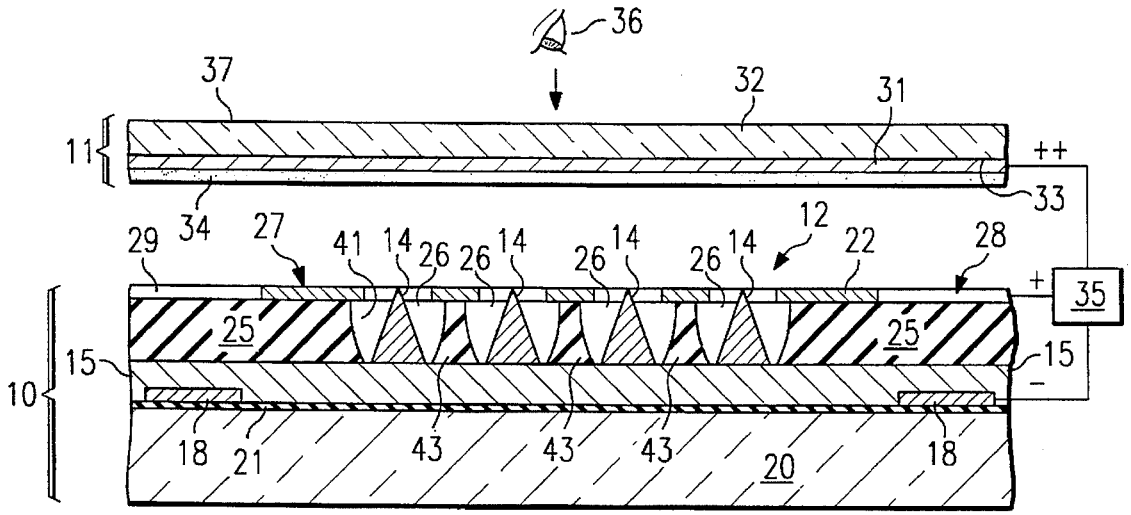
FIG. 1 (PRIOR ART)
FIGS. 1–4, already described and relating to the prior art, illustrate a typical "subpixel mesh" electron emitting structure fabricated utilizing conventional thin-film deposition techniques, and embodied in an FED flat-panel image display device.
Figure 2:
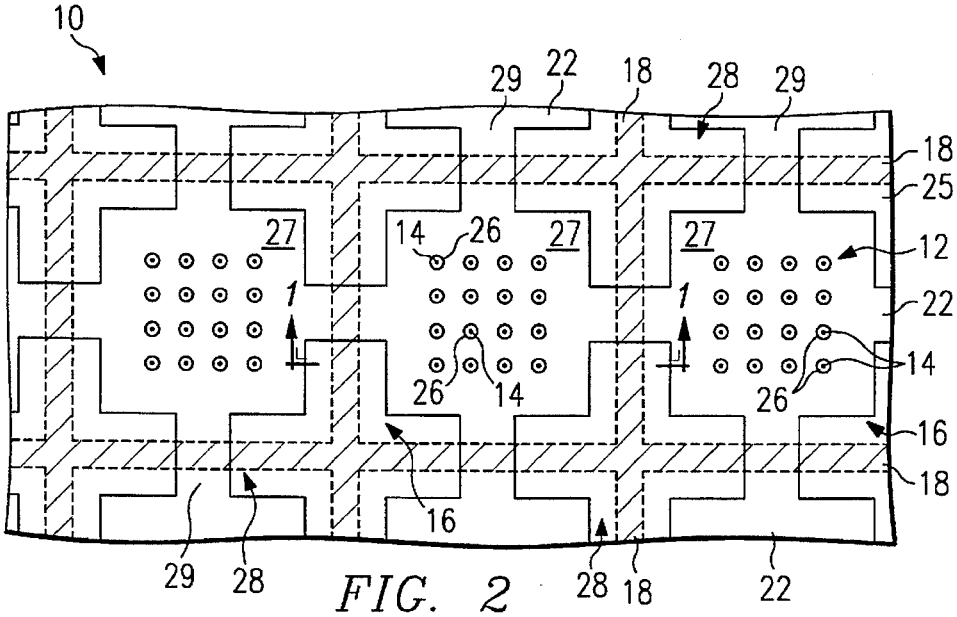
FIG. 2 (PRIOR ART)
Figure 3:
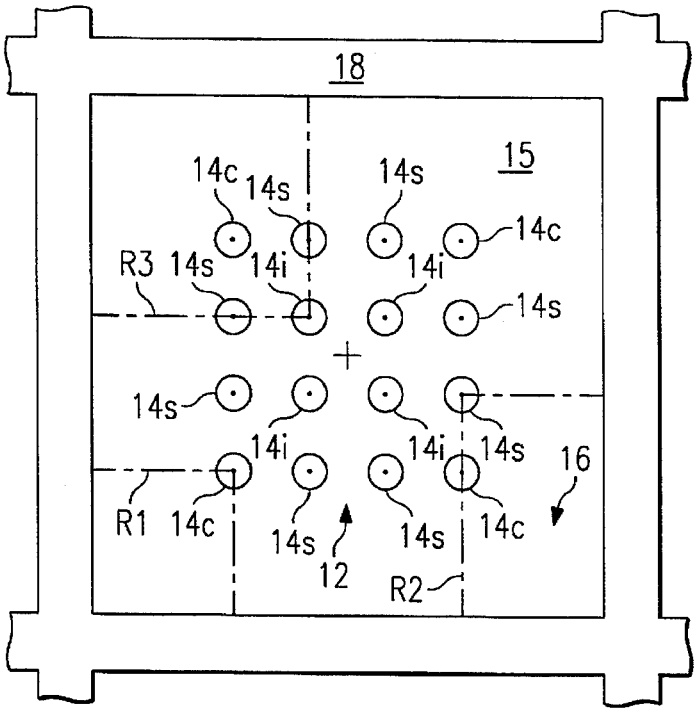
Figure 4:
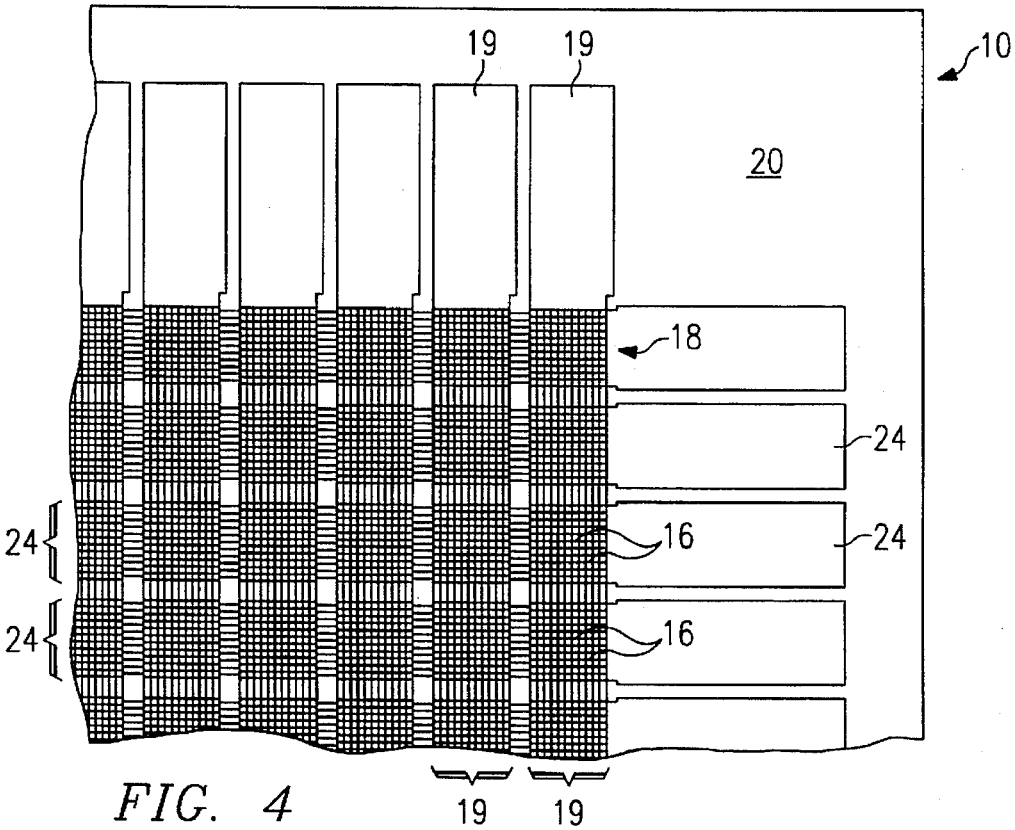
FIG. 4 (PRIOR ART)
Figure 5:
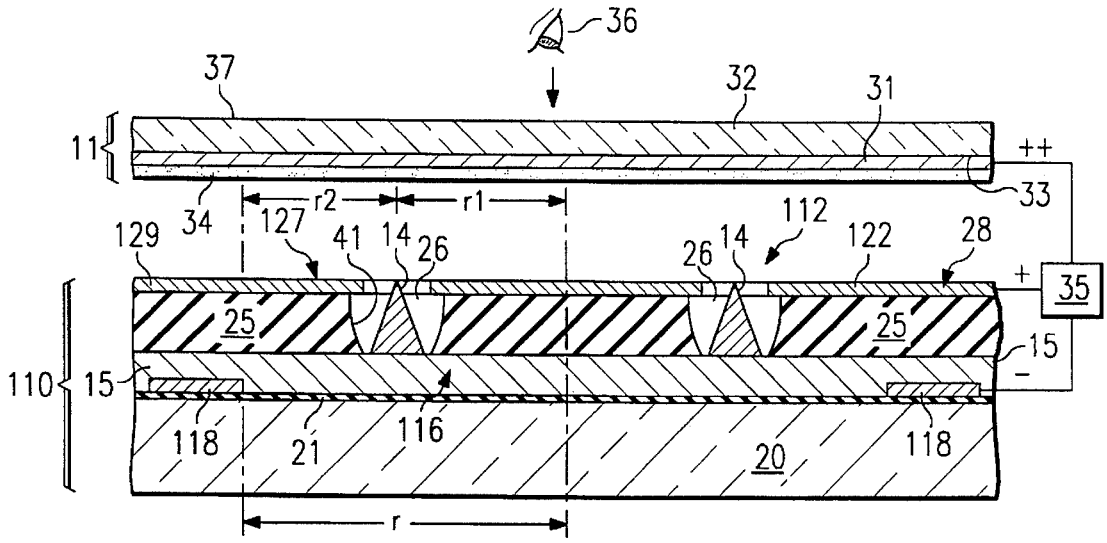
FIGS. 5–6, 7A–7C and 8A–8C illustrate embodiments of the invention.
Figure 6:
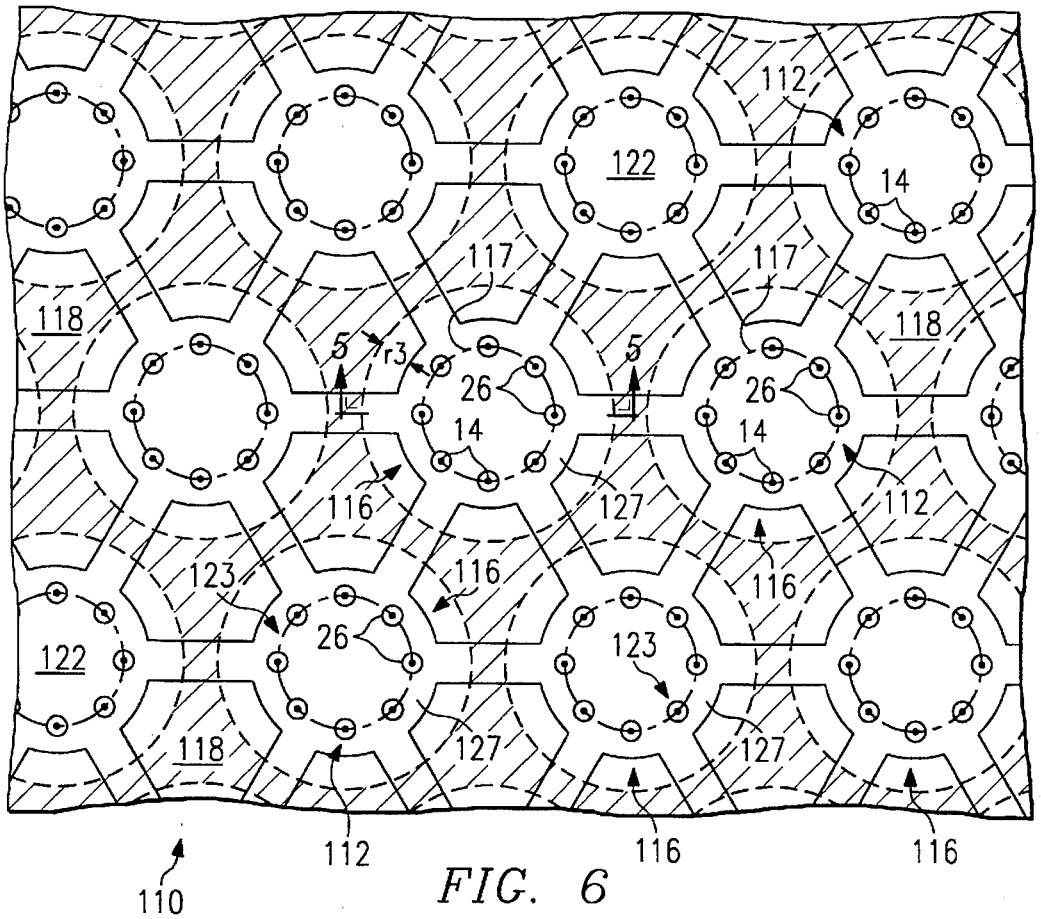

FIGS. 5 and 6 illustrate an embodiment of an FED flat-panel image display device, incorporating an electron emitter plate 110 fabricated in accordance with the teachings of the present invention.

As with the device of FIGS. 1–4, the emitter plate 110 is spaced across a vacuum gap from an anode plate 11, which may be identical to the anode plate 11 previously described. Likewise, as with the previously described emitter plate 10 (see FIG. 2), emitter plate 110 comprises a cathode electrode having a plurality of clusters of similar electrically conductive microtips 14 formed in cellular arrays 112 on a resistive layer 15 (see FIG. 5) within respective mesh spacings of a conductive layer mesh structure 118 patterned in column stripes 19 (see FIG. 4) on an upper surface of a glass or other substrate 20. Unlike with emitter plate 10, however, mesh structure 118 of emitter plate 110 is configured to provide mesh spacings 116 (shown in dashed lines in FIG. 6) which are circular, and microtips 14 are arranged in circular arrays 112 located concentrically within the mesh spacings 116. Such positioning places each microtip 14 on a circle 117, at an identical radial distance r1 from the center of a circular spacing 116 and at an identical radial distance r2 from the circumference of the circular spacing 116 (see FIGS. 5 and 7A). All microtips 14 of the same circle 117 are, thus, laterally spaced by the same ballast resistive path R from the mesh structure 118.

Emitter plate 110 has a second conductive layer forming an extraction (or gate) electrode 122, deposited on the substrate 20 and spaced by and insulated from the resistive layer 15 and cathode mesh structure 118 by an intervening dielectric insulating layer 25 (see FIG. 5). Electrode 122 is patterned to form circular aperture islands or pads 127, each having a circular array 123 of apertures 26 arranged in one-to-one correspondence with the microtips 14 of a corresponding array 112 and located concentrically within a respective cathode electrode mesh spacing 116. Such patterning reduces the amount of metallization overlap between electrode 122 and mesh structure 118, thereby reducing the capacitance of the overall structure. The respective radii of mesh spacings 116 and pads 127 are chosen to leave an annular gap of radial width r3 (see FIG. 6) between the circumferences of the pads 127 and the mesh spacings 116. The extraction electrode 122 comprises an electrically conductive layer of row-defining cross-stripes 24 (see FIG. 4) that run transversely to stripes 19 defined by the cathode electrode mesh structure 118. Electrical communication between neighboring pads 127 of the same cross-stripe 24 is established by means of radially extending, spoke-like bridging strips 129, left between pads 127 in the patterning of conductive layer 122.

The size of apertures 26 in the arrangement of FIG. 6 can be the same as the size of apertures 26 in the arrangement of FIGS. 1–4, and similar self-alignment techniques can be used to obtain an initial alignment for forming microtips 14 in general concentric alignment within apertures 26. A conventional process for fabrication of thin-film microtip emission cathode structures of the type shown in FIGS. 1–4 is generally described in Spindt U.S. Pat. No. 3,755,704 and Meyer U.S. Pat. No. 5,194,780. Patterning modifications can be made, as necessary, to produce the circular mesh spacings 116 and circular configurations of the arrays 112, 123.

A cathode mesh structure 118, resistive layer 15, dielectric insulating layer 25 and gate electrode layer 122 (FIG. 5) are successively formed on an upper surface of a glass substrate 20, which has been optionally previously overlaid with a thin layer 21 of silicon dioxide ($SiO_2$) of about 500–1000 Å thickness. The cathode structure 118 may, for example, be formed by depositing a thin coating of conductive material, such as niobium of about 2,000 Å thickness over the silicon dioxide layer 21. The circular mesh pattern of structure 118 and patterns defining the columns 19 may then be produced in the conductive coating by photolithography and etching to give, e.g., mesh-defining strips of 2–3 micron widths, providing 25–30 micron hexagonal close-packed arrangements of circular mesh spacings 116 (see FIG. 6), at approximately 100–130 mesh spacings per 300 micron pixel, with column-to-column separations of 50 microns (see FIG. 4). Resistive layer 15 may, for example, be formed as a resistive, undoped silicon coating of, e.g., 10,000–12,000 Å thickness, deposited by cathode sputtering or chemical vapor deposition over the patterned conductive layer 118. Alternatively, resistive layer 15 can be deposited first, before deposition of the conductive cathode structure layer 118. Spacer layer 25 may, for example, be formed as a silicon dioxide ($SiO_2$) layer of 1.0–1.2 micron thickness deposited by chemical vapor deposition over the patterned mesh structure 118, with the resistive coating 15 left exposed within the mesh spacings 116. Gate electrode layer 122 may, for example, be formed by depositing a thin metal coating of niobium with, e.g., 2,000 Å thickness over the spacer layer 25. The thicknesses and manners of deposition of the various layers above and below are given for illustrative purposes only, and not by way of limitation.

Next, gate layer 122 is masked and etched to define apertures 26 of, e.g., 1.0–1.4 micron diameters arranged in circular arrays at, for example, 25 micron pitches between arrays. The insulating layer 25 is also etched to form cavities 41 (FIG. 5) in alignment with apertures 26. Thereafter, while rotating the substrate 20, a sacrificial lift-off material layer of, e.g., nickel is deposited by low-angle electron beam deposition over layer 122. The beam is directed at an angle of 5°–20° to the surface (70°–85° from normal) so as to deposit lift-off layer material on the circumferential walls of apertures 26. Then, with substrate 20 again being rotated, molybdenum and/or other conductive tip forming material is deposited on the resistive layer 15 inside the cavities 41 by directing a beam substantially normal to the apertures 26 to form pluralities of arrays of microtips 14, self-aligned in respective concentric alignment within the apertures 26 and cavities 41. The nickel lift-off layer is then removed, together with the superfluous molybdenum deposited over the nickel. Subsequent masking and etching is used to pattern the apertured layer 122, to define the row cross-stripes 24 (see FIG. 4), the pads 127 and the bridging strips 129 (see FIG. 6). Row cross-stripes 24 may, for example, be formed with widths of 300–400 microns and spacings of 50 microns. Pads 127 are formed as nominal 15 micron diameter circles centered at 25 micron pitches over the mesh spacings 116 and with spoke-like bridging strips 129 of 2–3 micron widths.

Figure 7A:
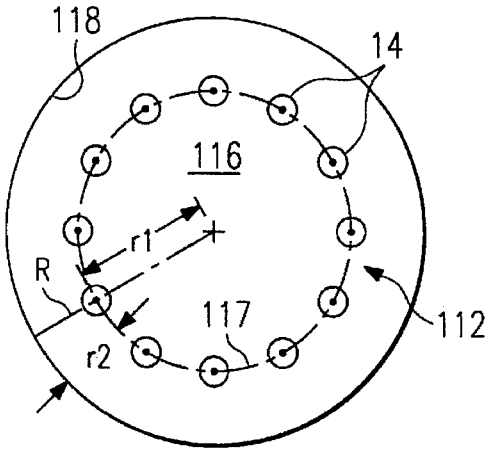
Figure 8A:
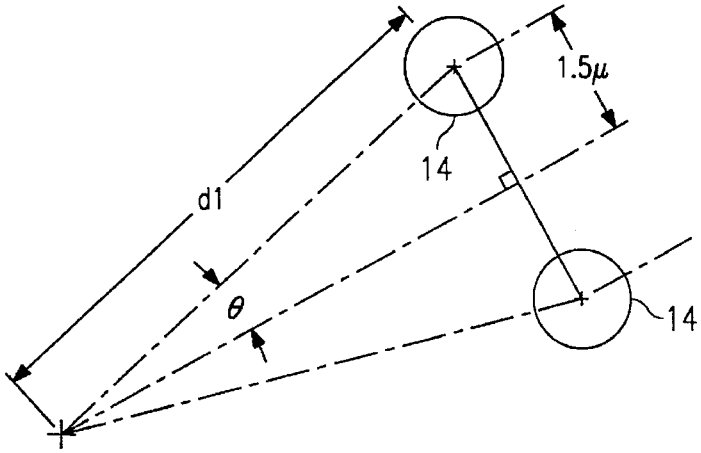

FIG. 6 shows an exemplary arrangement of emitter plate 110 having a circular array 112 of eight microtips 14, located at equiangular distances about a single circle 117. The same arrangement 112 is shown in FIG. 7A, however, with twelve microtips 14. How the radius r1 of circle 117 will vary for the same spacing between microtips 14, is for different numbers of microtips 14, shown in Table 1, for apertures 26 of radius 1.3 microns and center-to-center aperture spacings of 3.0 microns (see FIG. 8A). The half-angle θ of the arc 2θ will vary with the number of microtips 14 spaced about circle 117. The minimum radius r1 of circle 117 can, therefore, be determined from the equation: $r1=1.5\backslash\sin\theta$. Table 1 shows different radii r1 of the circle 117 and r of circular mesh spacings 116 for five different numbers of microtips 14. For comparison purposes, a four-by-four array 12 shown in FIG. 3 has sixteen emitters 14 and may, for example, have a mesh structure 18 strip width of 2.0 microns and a distance of 7.0 microns between an outermost emitter 14 and mesh structure 18. Using a distance r2 (see FIG. 7A) of 7.0 microns and a minimum width at bridging strip 129 crossings (see FIG. 5) for mesh structure 118 of 2.0 microns, the pitch (center-to-center spacing) of circular mesh spacings 116 for different numbers of emitters 14 is given in Table 1. For the four-by-four rectangular matrix array of FIG. 3, a typical pitch is 25–30 microns. As shown in Table 1, the pitch for sixteen emitters in the circular arrangement is only slightly greater.

TABLE 1

| No. Emitters | r1 (Microns) | r = r1 + r2 (Microns) | Pitch (Microns) |
|---|---|---|---|
| 6 | 3.0 | 10.0 | 22.0 |
| 8 | 3.9 | 10.9 | 23.8 |
| 12 | 5.8 | 12.8 | 27.6 |
| 16 | 7.7 | 14.7 | 31.4 |
| 20 | 9.6 | 16.7 | 35.4 |

Figure 7B:
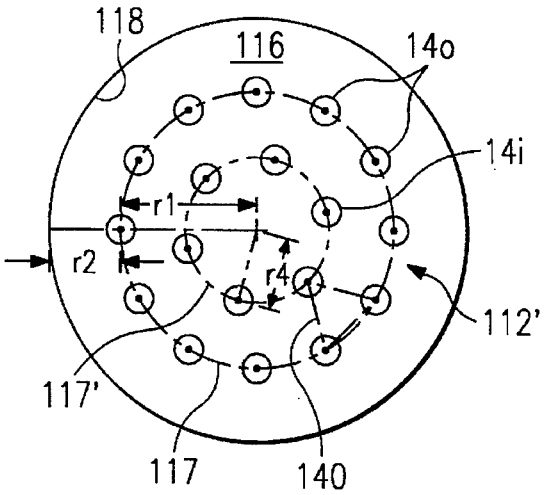
Figure 8B:
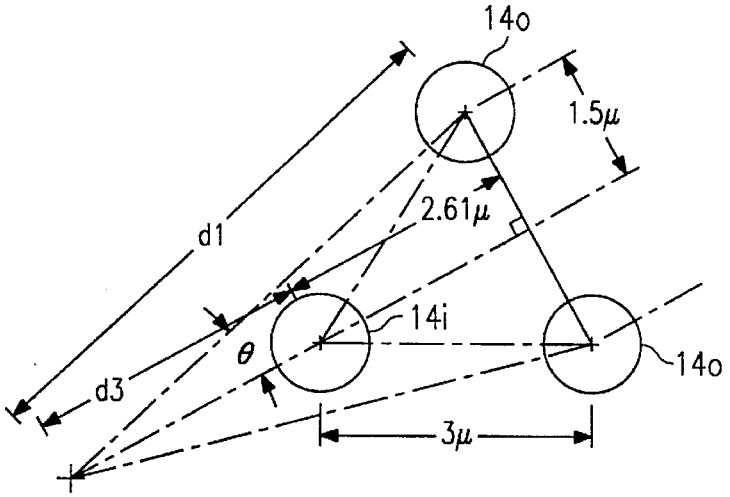

To increase microtip density in the circular arrangement, above that of the 4×4 rectangular array, a secondary ring 117' can be added inside the primary ring 117, as shown in FIG. 7B. The arrangement in FIG. 7B has a microtip **14*i* on the inside circle 117' prime placed at every other location between each pair of microtips 14*o* of the outside circle 117. Each mircrotip 14*o* may, for example, be spaced at 3.0 micron spacing from every other microtip 14*o*, and each microtip 14*i* is spaced at 3.0 micron spacing from two nearest microtips 14*o* (see FIG. 8B). This gives an inner circle 117' radius of r4=r1−1.61 microns, with the difference in radii of the circles 117, 117' being the height of the equilateral triangle 140 (FIG. 7B) defined by lines joining the centers of each microtip 14*o*, 14*i* triplet. Table 2 shows the radii r1, r4, r=r1+r2 and pitch for arrays 112' with different numbers of emitters 14, with r2=7.0 microns and 2.0 micron minimum mesh structure 118 strip width. For twelve emitters (eight in the primary circle 117 and four in the secondary circle 117'), the radius r1 of circle 117 is 3.9 microns (same as for eight emitters in Table 1), and the radius r4 of the secondary circle would have to be 1.3 microns, which is less than the 1.5 micron smallest allowable radius (for 3.0 micron smallest separation between diametrically opposed microtips 14*i*). For eighteen emitters (twelve in primary circle 117 and six in secondary circle 117'), however, the circle 117 radius is 5.8 microns and the circle 117 radius is 3.2 microns which exceeds the minimum allowable radius for circle 117' and places microtips 14*o* at greater than 3.0 micron spacings. The pitch between circles 116 for the eighteen microtip array 112' case is 27.6 microns, thereby achieving a higher packing density than with a four-by-four rectangular matrix arrayed within generally the same pixel area. The potential of microtips 14*i* will be only slightly different from the potential of microtips 14*o*, because of the close packing relationships between the micro tips 14*i* and 14*o* (the difference in radii between r1 and r4 is only 2.61 microns). Thus, greater packing density is achieved with only a small sacrifice in uniformity. By comparison, each microtip 14*i* is separated by 3.0 microns from adjacent microtips 14*s* and by 4.23 microns from neighboring microtips 14*c* in the rectangular array 12 of FIG. 3**, giving a much greater disparity.

TABLE 2

| No. Emitters | r1 (Microns) | r4 (Microns) | r = r1 + r2 (Microns) | Pitch |
|---|---|---|---|---|
| 12 | 3.9 | 1.3 | 10.9 | 23.8 |
| 18 | 5.8 | 3.2 | 12.8 | 27.6 |
| 24 | 7.7 | 5.1 | 14.7 | 31.4 |
| 30 | 9.6 | 7.0 | 16.7 | 35.4 |

Figure 7C:
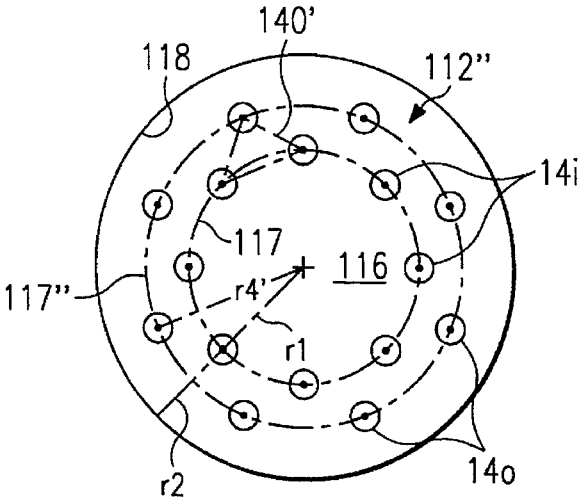
Figure 8C:
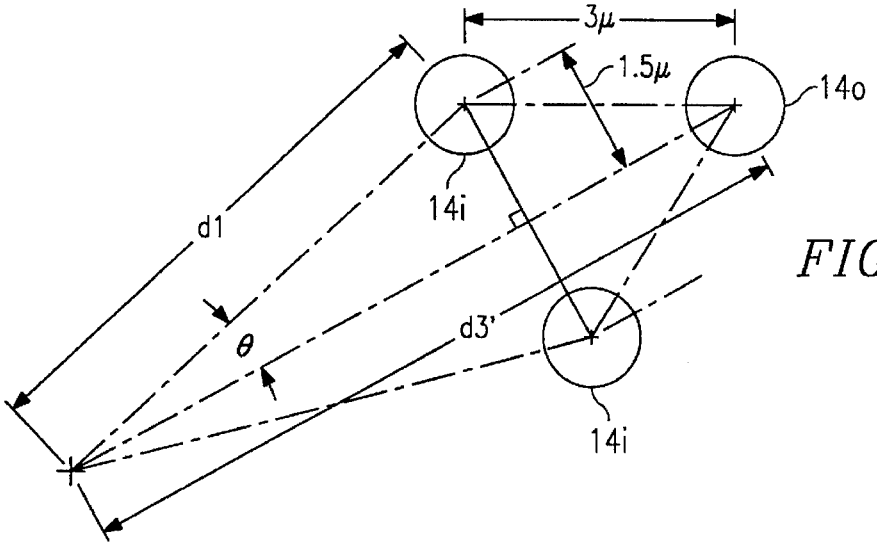

An alternative arrangement, illustrated in FIGS. 7C and 8C, places inside microtips **14*i* on the circle 117 and outside microtips 14*o* on a secondary circle 117", externally of circle 117. Each microtip 14*o* forms an equilateral triangle 140' with an underlying pair of microtips 14*i*, with spacing between microtips 14*i* and 14*o* again being 3.0 microns. Table 3 shows different radii r1, r4', r=r1+r2 and pitches for different numbers of emitters 14 for various arrays 112". It is noted that the number of microtips 14*i*. Such arrangement, for example, gives a 29.0 micron pitch for a fifteen microtip array 112". The arrangement 112', therefore, gives a greater packing density than the arrangement 112"**.

TABLE 3

| No. Emitters | r1 (Microns) | r4' (Microns) | r = r1 + r2 (Microns) | Pitch |
|---|---|---|---|---|
| 11 | 3.0 | 5.6 | 12.6 | 27.2 |
| 15 | 3.9 | 6.5 | 13.5 | 29.0 |
| 23 | 5.8 | 8.4 | 15.4 | 32.8 |
| 31 | 7.7 | 10.3 | 17.3 | 26.6 |

The described invention makes possible the achievement of greater uniformity of microtip emitter potential in a mesh subpixel type field emission device. Placing all microtips 14 about a circle 117 within circular mesh spacings 116, provides identical lateral resistive paths R between the conductive mesh structure 118 and each microtip 14 of the array 112. Adding additional microtips on a secondary circle 117' or 117", located internal or external to the primary circle 117, and placing the microtips 14 of the secondary circle in equilateral triangular relationships to the microtips of the primary circle 117, increases packing density of microtips 14 with little loss in resistive path uniformity.

Those skilled in the art to which the invention relates will appreciate that various substitutions and modifications can be made to the described embodiments, without departing from the spirit and scope of the invention as defined by the claims below.

What is claimed is:

1. An electron emitter plate comprising:

a substrate;

a first layer of conductive material deposited on said substrate; said first layer of conductive material being patterned in a mesh structure defining a mesh spacing with a center;

a layer of insulating material deposited on said substrate over said first layer of conductive material;

a second layer of conductive material deposited on said substrate over said layer of insulating material; said second layer of conductive material having a plurality of apertures; said apertures being arranged on a circle located concentrically within said mesh spacing and being uniformly spaced from said mesh structure;

a conductive microtip formed in each aperture in electrical communication with said first layer of conductive material; and a layer of resistive material laterally spacing said microtips by like resistive paths from said mesh structure.

2. The electron emitter plate of claim 1, wherein said mesh spacing is a circular mesh spacing.

3. The electron emitter plate of claim 1, wherein said second layer of conductive material has a second plurality of apertures arranged on a second circle located concentrically within said mesh spacing and uniformly spaced from said mesh structure; and conductive microtips formed in each of said second plurality of apertures in electrical communication with said first layer of conductive material; said layer of resistive material laterally spacing said microtips in said second plurality of apertures by other like resistive paths from said mesh structure.

4. The electron emitter plate of claim 3, wherein each aperture of one of said first and second circles of apertures is located in an equilateral triangular relationship with two apertures of the other of said first and second circles of apertures.

5. The electron emitter plate of claim 4, wherein said second circle is located within said first circle.

6. The electron emitter plate of claim 4, wherein said second circle is located outside said first circle.

7. The electron emitter plate of claim 4, wherein said apertures are positioned at equiangular locations about said respective first and second circles.

8. The electron emitter plate of claim 7, wherein each said first and second circle has at least six apertures.

9. The electron emitter plate of claim 1, wherein said second layer of conductive material is patterned to form a pad located centrally within said mesh spacing; and a bridging strip connecting said pad to other parts of said second layer of conductive material; said aperture array being located on said pad.

10. The electron emitter plate of claim 9, wherein said mesh spacing is circular and said pad is a circular pad located concentrically within said circular mesh spacing.

11. An image display device comprising the electron emitter plate of claim 1, and further comprising an anode plate spaced from said emitter plate and including an anode substrate, another layer of conductive material deposited on said anode substrate, and cathodoluminescent material in electrical communication with said another layer of conductive material.

12. An electron emitter plate comprising:

a substrate;

a first layer of conductive material deposited on said substrate; said first layer of conductive material being patterned in a mesh structure defining a plurality of mesh spacings;

a layer of insulating material deposited on said substrate over said first layer of conductive material;

a second layer of conductive material deposited on said substrate over said layer of insulating material; said second layer of conductive material having a cluster of apertures located within each mesh spacing; said apertures of each cluster being arranged in a circle located concentrically within said associated mesh spacing and being uniformly spaced from said mesh structure;

a conductive microtip formed in each aperture in electrical communication with said first layer of conductive material; and a layer of resistive material laterally spacing said microtips by like resistive paths from said mesh structure.

13. The electron emitter plate of claim 12, wherein each mesh spacing is a circular mesh spacing.

14. The electron emitter plate of claim 13, wherein said second layer of conductive material is patterned to form circular pads respectively located concentrically within said mesh spacings; said aperture clusters being respectively located on said pads.

15. The electron emitter plate of claim 12, wherein said first layer of conductive material is patterned in stripes; and said second layer of conductive material is patterned in cross-stripes; said stripes and cross-stripes intersecting at pixel-defining locations.

16. An image display device comprising the electron emitter plate of claim 12, and further comprising an anode plate spaced from said emitter plate and including an anode substrate, another layer of conductive material deposited on said anode substrate, and cathodoluminescent material in electrical communication with said another layer of conductive material.

17. The electron emitter plate of claim 12, wherein said first layer of conductive material is patterned in stripes; and said second layer of conductive material is patterned in cross-stripes; said stripes and cross-stripes intersecting at pixel-defining locations.

18. An electron emitter plate comprising:

a substrate;

a conductive mesh structure on said substrate defining a plurality of circular mesh spacings;

insulating material on said substrate over said mesh structure;

conductive circular paths on said substrate over said insulating material; said paths being respectively concentrically located within said mesh spacings and each pad having an array of apertures located on a circle concentric with said pad;

a conductive microtip formed in each aperture in electrical communication with said first layer of conductive material; and resistive material laterally spacing said microtips by like resistive paths from said mesh structure.

19. An electron emitter plate comprising:

a substrate;

a first layer of conductive material deposited on said substrate; said first layer of conductive material being patterned in a mesh structure defining a circular mesh spacing with a center;

a layer of insulating material deposited on said substrate over said first layer of conductive material;

a second layer of conductive material deposited on said substrate over said layer of insulating material; said second layer of conductive material having a plurality of at least six apertures; said apertures being arranged on a circle located concentrically within said mesh spacing; and a conductive microtip formed in each aperture in electrical communication with said first layer of conductive material.

* * * * *